US012486729B2

(12) United States Patent
Malki et al.

(10) Patent No.: US 12,486,729 B2
(45) Date of Patent: Dec. 2, 2025

(54) EXPANDABLE LINER REMOVAL WELL TOOL

(71) Applicant: Saudi Arabian Oil Company, Dhahran (SA)

(72) Inventors: Bandar S. Malki, Dammam (SA); Mohammed Alsheikh, Dammam (SA); Khaled W. Abuzaid, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 76 days.

(21) Appl. No.: 18/516,404

(22) Filed: Nov. 21, 2023

(65) Prior Publication Data

US 2025/0163781 A1 May 22, 2025

(51) Int. Cl.
*E21B 29/00* (2006.01)

(52) U.S. Cl.
CPC ..... *E21B 29/002* (2013.01)

(58) Field of Classification Search
CPC .... E21B 29/002; E21B 29/005; E21B 29/007; E21B 10/28; E21B 10/30; E21B 10/34
See application file for complete search history.

(56) References Cited

U.S. PATENT DOCUMENTS 2,619,325 A * 11/1952 Arutunoff ..... E21B 10/04 82/71
2,667,334 A * 1/1954 Ortloff ..... E21B 10/04 175/336
3,055,443 A * 9/1962 Edwards ..... E21B 10/04 175/333
4,111,262 A * 9/1978 Duncan ..... E21B 31/08 166/99
4,527,644 A * 7/1985 Allam ..... E21B 10/04 175/336
4,892,159 A * 1/1990 Holster ..... E21B 10/14 175/336
5,015,128 A * 5/1991 Ross, Jr. ..... B28D 1/041 408/67
5,145,017 A * 9/1992 Holster ..... E21B 10/14 175/336
5,497,841 A * 3/1996 Cox ..... E04G 23/0218 175/333
10,344,563 B2 7/2019 Esslemont et al.
2025/0003305 A1* 1/2025 Borg ..... E21B 29/002

FOREIGN PATENT DOCUMENTS

AU 2014332108 1/2018
CA 3057345 7/2022

* cited by examiner

*Primary Examiner* — Robert E Fuller
(74) *Attorney, Agent, or Firm* — Fish & Richardson P.C.

(57) ABSTRACT

A well tool for removing an expandable liner in a wellbore includes a substantially cylindrical tool body oriented about a longitudinal axis, a blade edge connected to the tool body and positioned along a radial perimeter of the tool body, and a blade system connected to the tool body and including a base plate and multiple blades connected to the base plate. The blade edge is positioned at a longitudinal end of the tool body. The multiple blades are oriented about the longitudinal axis on the base plate.

20 Claims, 5 Drawing Sheets

EXPANDABLE LINER REMOVAL WELL TOOL

TECHNICAL FIELD

The present disclosure generally relates to downhole cutting tools, more particularly, well tools for removing downhole liners.

BACKGROUND

Drilling, operating, and maintaining wellbores includes placing casings and liner joints within a wellbore. Casings can become damaged, such as due to corrosion, high temperatures and pressures downhole, or the caustic downhole environment. Expandable liners are placed in a wellbore against a casing to repair damaged casing and terminate communication between the wellbore and a surrounding formation through the damaged casing. Some cutting well tools are used to remove liner components in a wellbore.

SUMMARY

This disclosure describes well tools, for example, for separating and removing a liner from a wellbore casing.

Some aspects of the disclosure encompass a well tool for removing an expandable liner in a wellbore. The well tool includes a substantially cylindrical tool body oriented about a longitudinal axis, a blade edge connected to the tool body and positioned along a radial perimeter of the tool body, and a blade system connected to the tool body and including a base plate and multiple blades connected to the base plate. The blade edge is positioned at a longitudinal end of the tool body. The multiple blades are oriented about the longitudinal axis on the base plate.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
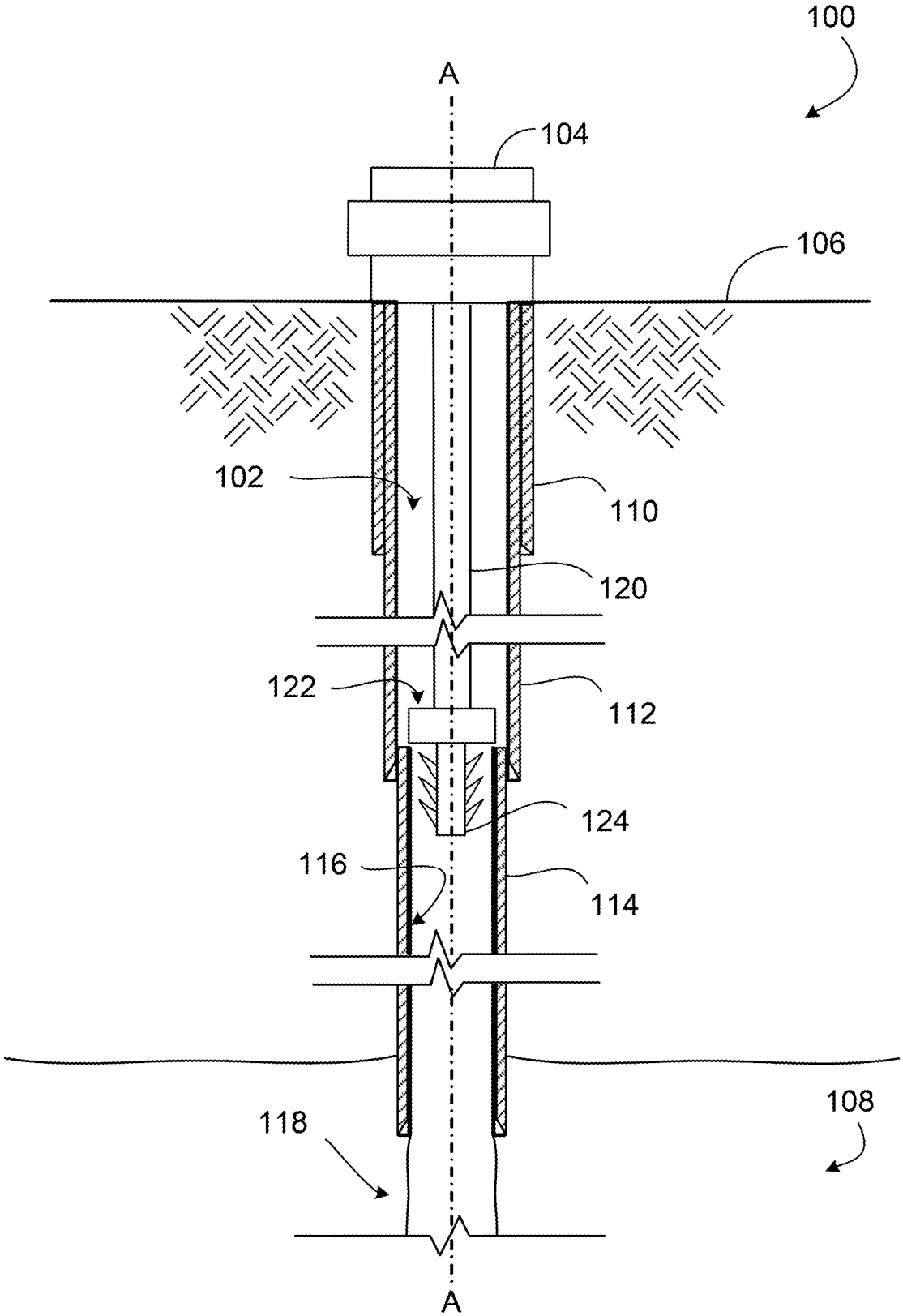
FIG. 1 is a schematic, partial cross-sectional side view of an example well system including an example well tool.

This disclosure describes well tools for cutting and removing all or a portion of an expandable liner from a casing in a wellbore. An example well tool includes a tool body with a substantially cylindrical shape centered on a longitudinal axis, a blade edge connected to the tool body and positioned along a radial perimeter of the tool body, and a blade system connected to the tool body. The blade edge can be coupled to or integrally formed with the tool body, is positioned at a downhole end of the tool body, and wedges itself between a liner and a casing to peel the liner away from the casing. The blade system includes multiple blades, such as helical blades carried on a base plate, that slice, shred, or otherwise cut the peeled liner into smaller pieces. The well tool provides an effective and designed cutting mechanism for peeling an expandable liner away from a casing without damaging the casing, while also simultaneously collecting the peeled liner with the well tool. The blade edge of the well tool peels, or shaves off, the liner layers from the casing from inside out to separate the liner's radially outer surface from the casing's radially inner surface, the blade system includes a motor to run the multiple blades, and one or more centralizers stabilize the well tool within the wellbore and catch or collect the shaved, peeled portion of the liner. The well tool can be powered mechanically, hydraulically, or electrically, and can be ran in hole on a drill pipe.

Expandable liners can be installed in a wellbore against a casing, for example, to repair damaged or corroded sections of the wellbore. In some examples, an expandable liner minimizes accessibility to the wellbore, such as in future workover operations. In some conventional well operations, the liner is milled with a milling tool. However, milling an expandable liner can be expensive due to the long operational hours required to mill the liner with a milling tool, such as a full gage mill similar to the size of an outer diameter of the liner in order to completely remove the liner. Also, a milling operation can introduce well integrity risks since the casing radially outward of the liner can be affected by the milling tool. In the present disclosure, a well tool includes a blade edge for separating a liner from a casing, multiple blades for cutting the separated liner, and in some examples, a centralizer that acts to centralize the well tool and collect the cut pieces of the separated liner. For example, the well tool excludes a milling surface, and instead includes a peeling blade for separating the liner from the casing without damaging the casing, and includes cutting blades internal to a tool body of the well tool to cut or shred the peeled portion of the liner without damaging the casing. The well tool of the present disclosure provides a safer, faster, and easier way to separate a liner from a casing while reducing or avoiding inadvertent damage to the casing. Also, implementing a cutting operation with a well tool of the present disclosure provides a reduced complexity solution to remove expandable liners, for example, by avoiding the need to mill a liner completely with a milling tool. Instead, the blade edge of the well tool can separate the metal-to-metal seal between an expandable liner and a casing, and collect the expandable liner to be retrieved partially or completely.

FIG. 1 is a schematic, partial cross-sectional side view of an example well system 100 that includes a substantially cylindrical wellbore 102 extending from a wellhead 104 at a surface 106 downward into the Earth into one or more subterranean zones of interest. In the example well system 100 of FIG. 1, one subterranean zone of interest 108 is shown. The subterranean zone of interest 108 can include a hydrocarbon reservoir from which hydrocarbons can be extracted. The well system 100 includes a vertical well, with the wellbore 102 extending substantially vertically from the surface 106 to the subterranean zone of interest 108. The concepts described here, however, are applicable to many different configurations of wells, including vertical, horizontal, slanted, split, or otherwise deviated wells.

After some or all of the wellbore 102 is drilled, a portion of the wellbore 102 extending from the wellhead 104 to the subterranean zone 108 can be lined with lengths of tubing, called casing. The wellbore 102 can be drilled in stages, and a casing may be installed between stages. In the example well system 100 of FIG. 1, the wellbore 102 is shown as having been drilled in multiple stages (for example, three stages), and the casings include a first casing 110, a second casing 112, and a third casing 114. The third casing 114 is also lined with a liner 116 on a radially inner side of the third casing 114. In some implementations, one or more or all of the casings can include a liner or a portion of a liner along some or all of an inner surface of the casings.

The first casing 110 can be defined by lengths of tubing lining a first portion of the wellbore 102, the second casing 112 can be defined by lengths of tubing lining a second portion of the wellbore 102, and the third casing 114 can be defined by lengths of tubing lining a third portion of the wellbore 102. These portions of the wellbore 102 can be overlapping. For example, the first casing 110 extends from the surface for a first length, the second casing 112 extends from the surface for a second, longer length that overlaps the first length, and the third casing 114 extends downhole a third length starting from a point near a downhole end of the second casing 112. The first casing 110 is shown as extending only partially down the wellbore 102; however, the first casing 110 can extend further into the wellbore 102, such as into the subterranean zone 108, or end further uphole in the wellbore 102 than what is shown schematically in FIG. 1. Likewise, the second casing 112 is shown as extending only partially along the wellbore 102 downhole of the first casing 110; however, the second casing 112 can extend further into the wellbore 102 or end further uphole in the wellbore 102 than what is shown schematically in FIG. 1. While FIG. 1 shows the example well system 100 as having three casings (first casing 110, second casing 112, and third casing 114), the well system 100 can include more surface casings or fewer surface casings, or more or fewer casings that begin at a location downhole of the surface 106. For example, the well system 100 can include one, three, four, or more surface casings, and any number of downhole casings. In some examples, the well system 100 excludes casings, and the wellbore 102 is at least partially or entirely open bore. The section(s) of the wellbore 102 exposed to the adjacent formation (for example, without casing or other permanent completion) form an open hole section 118 of the wellbore 102.

The wellhead 104 is installed over the open wellbore 102 on top of the casing, such as the first casing 110 and second casing 112. In some implementations, the well system 100 includes a pipe or tubing installed in the wellbore 102 prior to the installation of the casings 110 and 112, called a conductor, positioned adjacent to the first casing 110. The conductor is set into the surface 106 of the Earth and provides a foundation for the wellbore 102 to be drilled. The conductor is typically the first string of casing installed in the wellbore 102 and is lowered into the wellbore 102 and cemented in place, driven into the surface 106 (such as by a pile driver, or jetted into place such as in offshore wells), or otherwise positioned in the wellbore 102. The example well system 100 of FIG. 1 can include a single conductor or multiple conductors in or around the wellbore 102.

The wellhead 104 defines an attachment point for other equipment of the well system 100 to attach to the well 102. For example, the wellhead 104 can include a Christmas tree structure including valves used to regulate flow into or out of the wellbore 102. In the example well system 100 of FIG. 1, a well string 120 is shown as having been lowered from the wellhead 104 at the surface 106 into the wellbore 102. In the example well system 100 of FIG. 1, the well string 120 is a drill string that is run into the wellbore 102. However, the type of well string 120 can vary. In some instances, the well string 120 includes a series of jointed lengths of tubing coupled end-to-end or a continuous (or, not jointed) coiled tubing. For example, the well string 120 can include a wireline, coiled tubing, drill string, production string, work string, testing string, or other well string with a well tubing used during the lifetime of the well system 100. The well string 120 can include a number of different well tools that can test, produce, intervene, or otherwise engage the wellbore 102. An annulus is the annular space between the well string 120 and an inner wall of the wellbore 102, such as the inner wall of a casing or open bore portion of the wellbore 102.

In the example well system 100 of FIG. 1, a well tool 122 is disposed in the wellbore 102 on the well string 120 just uphole of the liner 116. The well tool 122 is a cutting tool for removing all or a portion of the liner 116, for example, by separating all or a portion of the liner 116 from the third casing 114 and cutting the separated portion of the liner 116 into smaller pieces. For example, the well tool 122 operates as a liner milling and retrieving tool running on a conventional drill pipe to a desired depth. The example well tool 122 includes a blade edge for initially slicing the liner 116 away from the third casing 114, and in some instances, includes a blade system that further cuts the liner 116 into smaller pieces. The blade edge is positioned at or within a space between the liner 116 and the third casing 114 at an uphole longitudinal end of the liner 116, and as the well tool 122 moves longitudinally downward (with or without corresponding rotation about axis A-A), the blade edge separates the liner 116 from the third casing 114 and guides the separated portion of the liner 116 into the blade system to be cut into smaller pieces. The smaller pieces of the liner 116 can flow uphole, can be collected by a centralizer 124 of the well tool 122, or both. The centralizer 124 of the example well tool 122 is positioned downhole of the blade edge and blade system, though the centralizer 124 can instead be positioned uphole of the blade structures. In some instances, the example well tool 122 includes a first centralizer uphole of the blade structures and a second centralizer downhole of the blade structures. The centralizer 124 includes a rod oriented along axis A-A, which is longitudinally oriented in the wellbore 102. The rod includes radially extending barbs, which are hook-shaped projections with an acute or concave profile on their respective longitudinally uphole sides. The barbs act to catch debris, for example, the shavings or cuts of the portion of the liner 116 that the example well tool 122 separates from the third casing 114. In some examples, the barbs also act to center the example well tool 122 within the wellbore 102, for example, aligned along axis A-A, so that the blade edge, which is sizes to be the same as the outer diameter of the liner 116, is properly centered in the wellbore 102 with respect to the liner 116.

Figure 2:
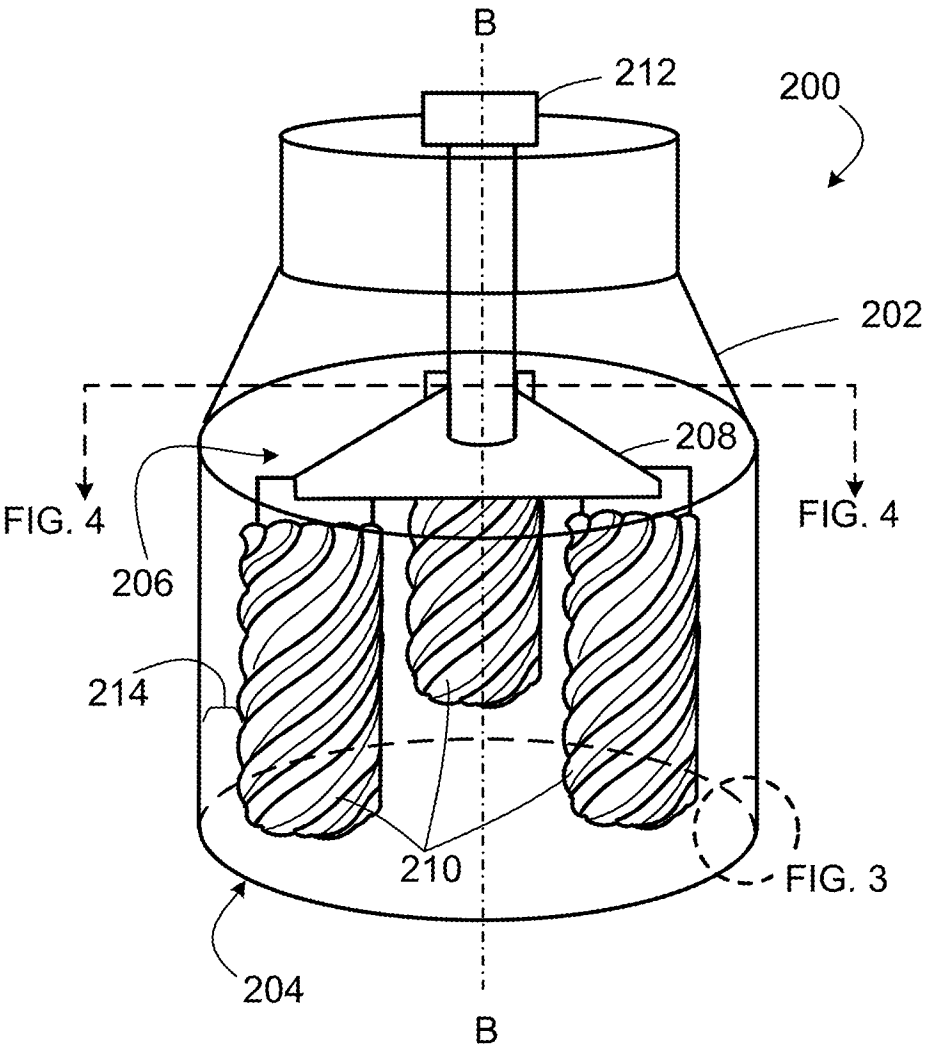
FIG. 2 is a schematic, partial cross-sectional front view of an example well tool that can be used in the example well system of FIG. 1.

FIG. 2 is a schematic, partial cross-sectional front view of an example well tool 200 that can be used in the example well tool 122 in the example well system 100 of FIG. 1. The example well tool 200 includes a tool body 202, a blade edge 204 connected to the tool body 202, and a blade system 206 connected to the tool body 202. The tool body 202 is substantially cylindrical, taking on a substantially cylindrical shape oriented along the central longitudinal axis B-B. The tool body 202 is substantially cylindrical, in that a portion of the tool body 202 has a cylindrical outer surface and a corresponding cylindrical inner surface for at least a portion of a longitudinal length of the tool body 202. The blade edge 204 connects to the tool body 202 at a longitudinally downhole end of the cylindrical portion of the tool body 202. The blade edge 204 can connect to, directly couple to, or be integrally formed with the tool body 202. For example, the blade edge 204 is formed of a rigid material, such as sharpened steel or other metal, and forms a sharp edge along a downhole end of the tool body 202 and follows a circular, or radial, perimeter of the tool body 202. In some implementations, the blade edge 204 is a cylindrical coring blade edge disposed at the longitudinally downhole end of the tool body 202. The blade edge 204 can extend along a portion of or the entirety of the perimeter edge of the tool body 202, for example, to form a circular blade edge for peeling a cylindrical liner from a cylindrical casing.

In some implementations, the tool body 202 has an outer diameter that is exactly or substantially the same as an outer diameter of a liner that is to be removed from an inner radial surface of an attached casing. In some examples, the blade edge 204 is positioned at this outer diameter to peel all or a portion of the liner away from the casing as the tool body 202 is longitudinally moved along a longitudinal length of the liner.

Figure 3:
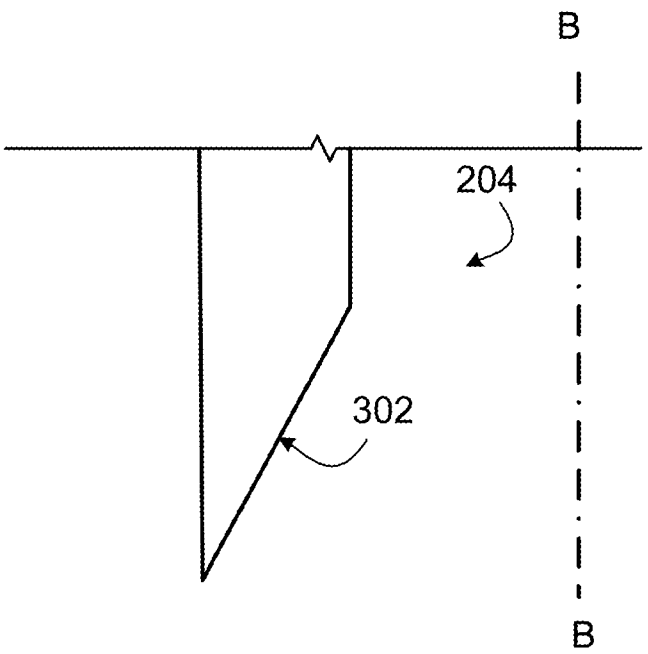
FIG. 3 is a close-up, partial, cross-sectional front view of an example blade edge that can be used in the example well tool of FIG. 2.

FIG. 3 is a close-up, partial, cross-sectional front view of the blade edge 204 of the example well tool 200 of FIG. 2. The blade edge 204 of the example well tool 200 is shown as having a single edged bevel profile, where a radially inner surface 302 of the blade edge 204 forms an angled inner surface. During operation, the single edged bevel edge is positioned at the space between the liner and the casing, and as the tool body 202 moves longitudinally, the blade edge 204 separates the liner from the casing and the angled inner surface 302 guides the separated portion of the liner radially inward (for example, toward axis B-B) and toward the blade system 206.

In some implementations, the blade edge 204 can take a different blade shape. For example, the blade edge 204 can include a double-edged bevel profile, a V-shape profile, convex profile, compound double bevel profile, compound single bevel profile, concave profile, or another edge profile sufficient to separate a liner from a casing.

In operation, the blade edge 204 creates separation between a liner and a casing positioned radially outward of the liner so that there is enough space to push the liner against the blade system 206. The blade edge 204 takes the form of a sharp edge of a parting tool to push the liner radially inward. The example well tool 200 can apply a longitudinal force, applied mechanically or hydraulically, to the blade edge 204 uphole of the liner in the space between the liner and casing. The blade edge 204 can be inserted into this space by force, the tool body 202 can be rotated so that the blade edge 204 cuts a narrow groove between the casing and liner and marks a sharp boundary for separation to take place, or both. For example, the sharp edge of the blade edge 204 can be inserted in the space between the liner and casing with a pre-pressurized piston, forced rotation, another force application, or a combination of these. A piston can be released through pressure pulses, rotation, or other hydraulic and mechanical mechanisms. In certain instances, the tool body 202 can be rotated such that the blade edge 204 shaves off a groove in an outer layer of the liner, for example, to create space for the separation of the liner from the casing.

Figure 4:
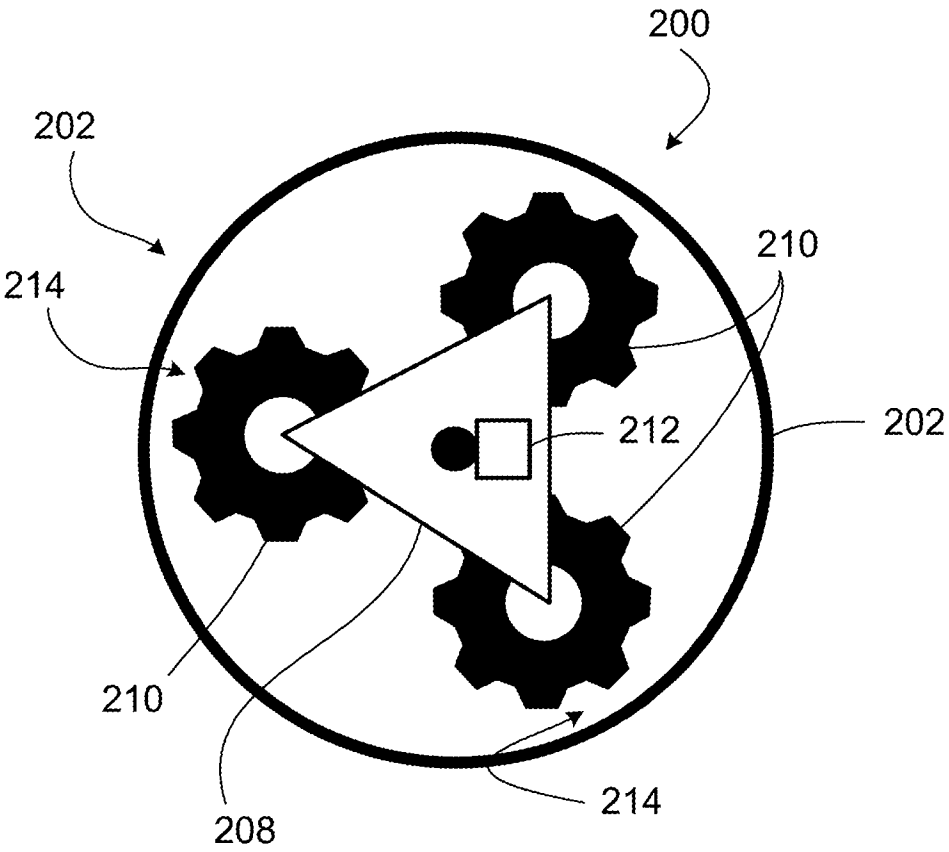
FIG. 4 is a schematic cross-sectional top view of the example well tool of FIG. 2.

FIG. 4 is a schematic cross-sectional top view of the example well tool 200 of FIG. 2. Referring to the example well tool 200 of FIGS. 2-4, the blade system 206 acts to cut the separated, or peeled, portion of the liner. In the example well tool 200 of FIGS. 2-4, the blade system 206 includes a base plate 208 and multiple blades 210 (three shown) coupled to the base plate 208. The blade system 206 is connected to the tool body 202, and the blades 210 are longitudinally oriented and spaced about the longitudinal axis B-B on the base plate 208. In the example well tool 200, the blades 210 are helical blades. However, the type of blade can vary for one or more or all of the blades 210 of the example well tool 200. Each blade 210 is oriented in parallel with the longitudinal axis B-B, in that the blades 210 are all parallel to each other. However, this orientation can be different, for example, based on the type of blade 210 or other factors. In some implementations, the base plate 208 is rotatable about the longitudinal axis B-B and carries the blades 210 around the longitudinal axis B-B during operation. The base plate 208 can be operated to rotate using a motor 212. The blades 210 are positioned radially inward of the blade edge 204 and at least partially uphole of the blade edge 204. During operation, the portion of the liner separated by the blade edge 204 is guided to a space 214, or gap, between an inner surface of the tool body 202 and the blades 210. As the blades 210 rotate via rotation of the base plate 208, edges of the blades 210 cut into the liner. The inner surface of the tool body 202 acts to radially contain the liner portion within the tool body 202 so that the one or more blades 210 can shred, slice, or otherwise cut the liner portion. In certain implementations, the base plate 208 is rotatable, and carries the blades 210 along its rotation. For example, the base plate 208 can rotate around the central longitudinal axis B-B and carry the blades 210 to peel off the expandable liner.

In some implementations, the blades 210 are aligned helical blades instead of tilted blades, for example, to concentrically cut or shave the liner. In operation, the blade edge 204 peels and guides the liner into the space 214 between the blades 210 and the inner surface 302 of the blade edge 204. After the liner is disposed in the space 214, the motor 212 can operate to rotate the base plate 208 to subsequently rotate the blades 210 and peel off an interior of the liner inside out until the section covered by the longitudinal length of the blades 210 is completely peeled off. Subsequent operations can be repeated. The motor 212 can operate hydraulically, mechanically, or electrically to rotate the blades 210 within the tool body 202.

Figure 5:
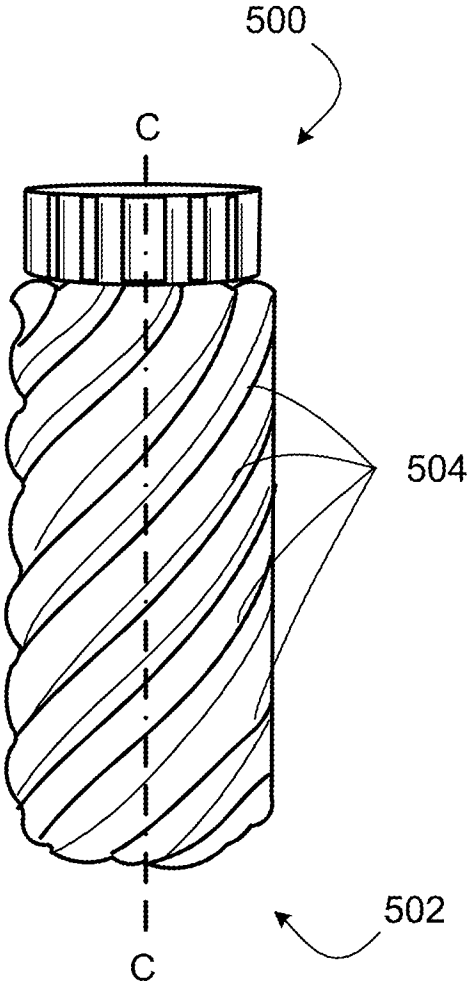
FIG. 5 is a perspective front view of an example helical blade that can be used in the example well tool of FIGS. 2 and 4.

FIG. 5 is a perspective front view of an example helical blade 500 that can be used in the example well tool 200 of FIGS. 2 and 4. For example, the helical blade 500 can be substituted into one or more or all of the blades 210 of the example well tool 200 of FIGS. 2 and 4. The example helical blade 500 includes a cylindrical body 502 with multiple helically-shaped edges 504 disposed about the cylindrical body 502. In some instances, the cylindrical body 502 is freely rotatable on an internal shaft, such that the cylindrical body 502 and corresponding edges 504 can rotate about a longitudinal axis C-C through a center of the internal shaft.

In some implementations, the example well tool 200 includes a centralizer connected to the tool body 202 and positioned longitudinally uphole of or longitudinally downhole of the tool body 202. The centralizer acts to center the blade edge 204 within a space, for example, within a wellbore or casing so that the blade edge 204 consistently and centrally peels a corresponding liner. In certain instances, the well tool 200 can include two centralizers: a first centralizer positioned longitudinally uphole of the tool body 202 and a second centralizer positioned longitudinally downhole of the tool body 202. One or two centralizers can aid in centering the tool body 202, and the corresponding blade edge 204, within a cylindrical space like a wellbore.

Figure 6:
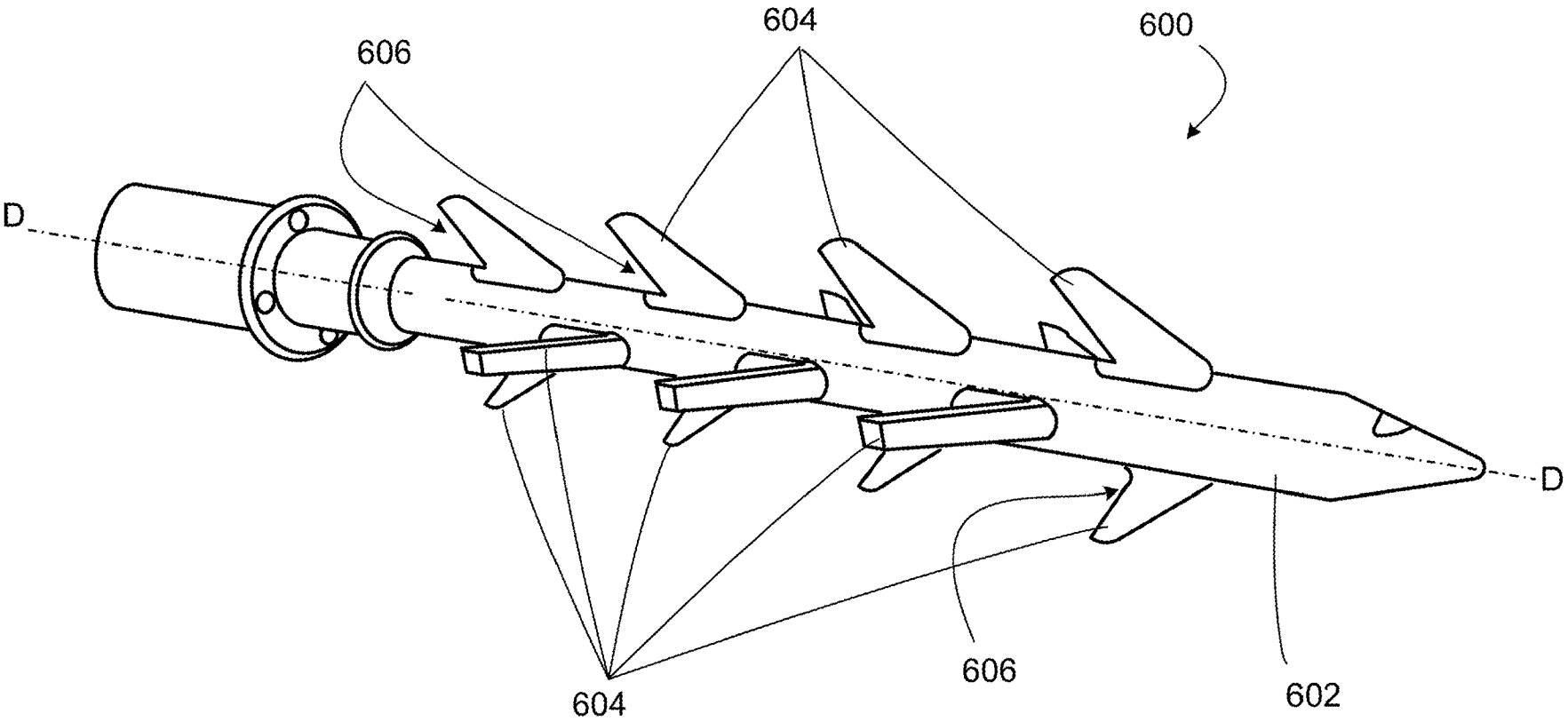
FIG. 6 is a schematic front perspective view of an example centralizer that can be used in the example well tool of FIG. 1.

FIG. 6 is a schematic front perspective view of an example centralizer 600 that can be used in the example well tool 122 and centralizer 124 of FIG. 1, or with the example well tool 200 of FIGS. 2 and 4. The example centralizer 600 includes a rod 602 oriented along a longitudinal axis D-D and multiple barbs 604 connected to the rod 602. The barbs 604 extend radially outward from the rod 602, and are oriented to catch or otherwise collect debris, such as cut portions of a liner from the blade system 206 of the example well tool 200. In some implementations, the barbs 604 are hook-shaped projections with an acute or concave upper profile 606 on their respective longitudinally uphole sides. The concave upper profiles 606 of the barbs 604 act to collect debris, such as the shavings or cuts of the portion of a liner. In some examples, the barbs 604 also act to center the centralizer 600, and any corresponding connected structures (such as the tool body 202 of the example well tool 200) within a cylindrical space.

In some implementations, the example centralizer 600 acts as a centrifugal guide that also collects shaved layers of liner and reduces or minimizes a volume of leftover junk left in a wellbore. In some examples, the centralizer 600 can include a wireline phishing tool, including the rod 602 and upwardly pointed barbs 604 that form hooks that can catch looped ends of shaved liner during a liner removal operation.

Figure 7:
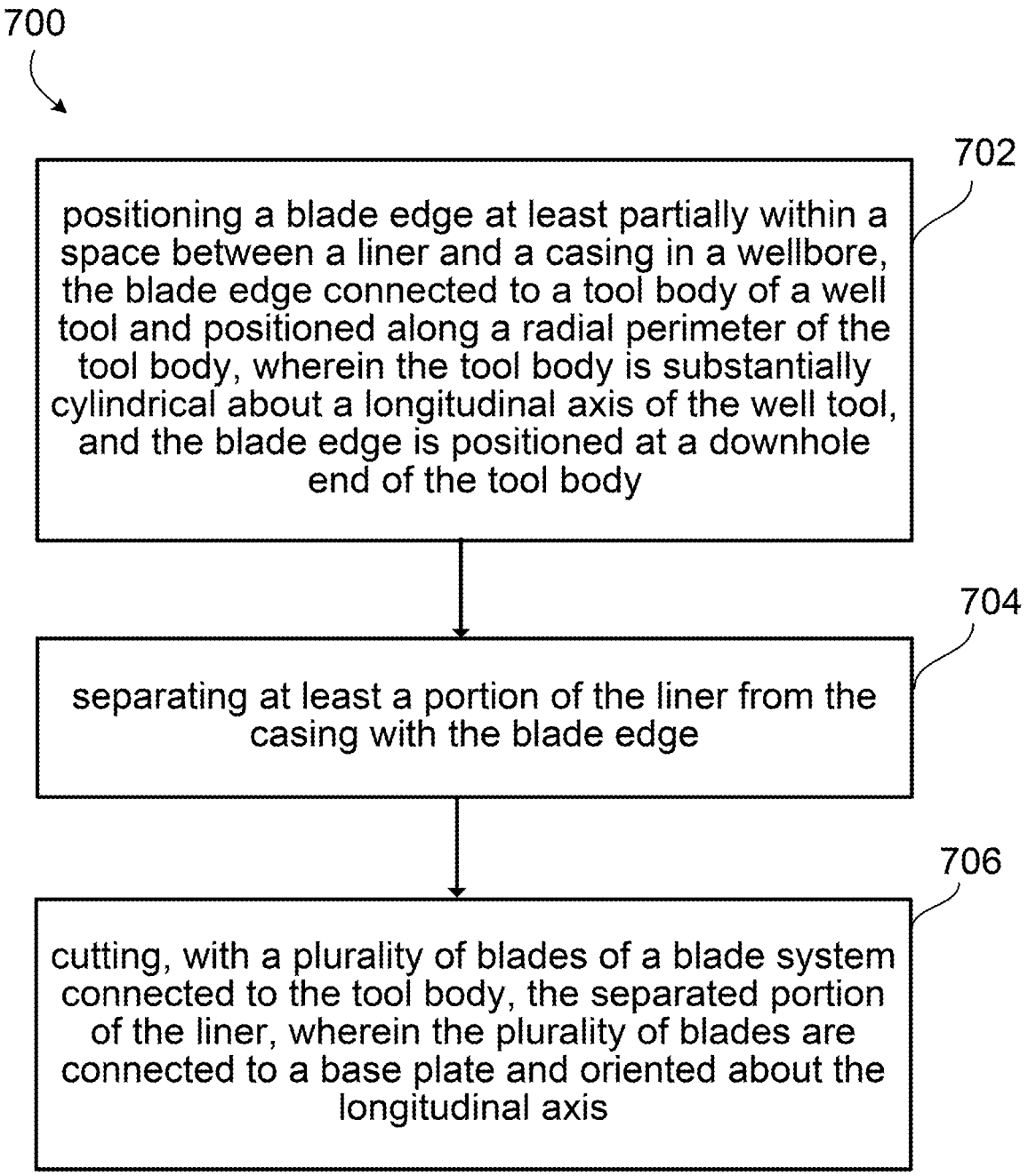
FIG. 7 is a flowchart describing an example method for removing a liner in a wellbore.

FIG. 7 is a flowchart describing an example method 700 for removing a liner in a wellbore, for example, performed by the example well tool 122 of FIG. 1 or the example well tool 200 of FIGS. 2 and 4. At 702, a blade edge is positioned at least partially within a space between a liner and a casing in a wellbore. The blade edge is connected to a tool body of a well tool and is positioned along a radial perimeter of the tool body. The tool body is substantially cylindrical about a longitudinal axis of the well tool, and the blade edge is positioned at a downhole end of the tool body. At 704, at least a portion of the liner is separated from the casing with the blade edge. At 706, a plurality of blades of a blade system connected to the tool body cuts the separated portion of the liner, for example, into smaller pieces. The plurality of blades are connected to a base plate and oriented about the longitudinal axis. In some instances, separating the liner from the casing with the blade edge includes forcing the blade edge in a longitudinal downhole direction between the portion of the liner and the casing. One or more or all of the blades can be helical blades, and cutting the separated portion of the liner can include shredding the separated portion of the liner with the helical blades. In certain implementations, the separated portion of the liner is guided into a space between blades and a radially inner surface of the tool body, the base plate is rotated about the longitudinal axis, and the separated portion of the liner is shredded with the blades within the space between the blades and the radially inner surface of the tool body. In an example, the blade edge is a single edged bevel with an angled inner surface, and the separated portion of the liner is guided with the angled inner surface of the blade edge toward the blades of the blade system. In some implementations, a centralizer connected to the tool body of the well tool collects the separated and cut portion of the liner. The centralizer can include a rod oriented along the longitudinal axis and multiple barbs connected to the rod and extending radially outward from the rod, and collecting the separated and cut portion of the liner includes catching the separated and cut portion of the liner with the barbs of the centralizer.

While this disclosure contains many specific implementation details, these should not be construed as limitations on the scope of what may be claimed, but rather as descriptions of features specific to particular implementations. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple products.

Thus, particular implementations of the subject matter have been described. Other implementations are within the scope of the following claims. Various modifications may be made without departing from the spirit and scope of the disclosure. In some cases, the actions recited in the claims can be performed in a different order and still achieve desirable results. In addition, the processes depicted in the accompanying figures do not necessarily require the particular order shown, or sequential order, to achieve desirable results.

Examples

In a first aspect, a well tool for removing a liner comprises a substantially cylindrical tool body oriented about a longitudinal axis, a blade edge connected to the tool body and positioned along a radial perimeter of the tool body, the blade edge positioned at a longitudinal end of the tool body, and a blade system connected to the tool body and comprising a base plate and a plurality of blades connected to the base plate, the plurality of blades oriented about the longitudinal axis on the base plate.

In a second aspect according to the first aspect, the blade edge is a cylindrical coring blade edge disposed at a longitudinally downhole end of the tool body.

In a third aspect according to the second aspect, the blade edge extends along an entire perimeter edge of the tool body.

In a fourth aspect according to any one of the first aspect to the third aspect, the blade edge is integrally formed with the tool body.

In a fifth aspect according to any one of the first aspect to the fourth aspect, the blade edge comprises a single edged bevel profile.

In a sixth aspect according to any one of the first aspect to the fifth aspect, the plurality of blades comprises a plurality of helical blades.

In a seventh aspect according to the sixth aspect, each helical blade in the plurality of blade is oriented in parallel with the longitudinal axis.

In an eighth aspect according to any one of the first aspect to the seventh aspect, the base plate is rotatable about the longitudinal axis and configured to carry the plurality of blades around the longitudinal axis.

In a ninth aspect according to any one of the first aspect to the eighth aspect, the plurality of blades are positioned radially inward of the blade edge and at least partially uphole of the blade edge.

In a tenth aspect according to any one of the first aspect to the ninth aspect, the well tool further comprises a centralizer connected to the tool body and positioned longitudinally uphole of or longitudinally downhole of the tool body, the centralizer configured to center the blade edge within a wellbore.

In an eleventh aspect according to the tenth aspect, the centralizer is a first centralizer positioned uphole of the tool body, the well tool further comprising a second centralizer positioned downhole of the tool body, the first centralizer and second centralizer configured to center the blade within the wellbore.

In a twelfth aspect according to the tenth aspect or the eleventh aspect, the centralizer comprises a rod oriented along the longitudinal axis and configured to be oriented longitudinally in the wellbore, and a plurality of barbs connected to the rod and extending radially outward from the rod, the plurality of barbs configured to catch debris residing in the wellbore.

In a thirteenth aspect, a method for removing a liner in a wellbore comprises positioning a blade edge at least partially within a space between a liner and a casing in a wellbore, the blade edge connected to a tool body of a well tool and positioned along a radial perimeter of the tool body, wherein the tool body is substantially cylindrical about a longitudinal axis of the well tool, and the blade edge is positioned at a downhole end of the tool body, separating at least a portion of the liner from the casing with the blade edge, and cutting, with a plurality of blades of a blade system connected to the tool body, the separated portion of the liner, wherein the plurality of blades are connected to a base plate and oriented about the longitudinal axis.

In a fourteenth aspect according to the thirteenth aspect, separating the at least a portion of the liner from the casing with the blade edge comprises forcing the blade edge in a longitudinal downhole direction between the portion of the liner and the casing.

In a fifteenth aspect according to the thirteenth aspect or the fourteenth aspect, the plurality of blades comprises a plurality of helical blades, and cutting the separated portion of the liner comprises shredding, with the plurality of helical blades, the separated portion of the liner.

In a sixteenth aspect according to any one of the thirteenth aspect to the fifteenth aspect, cutting the separated portion of the liner comprises guiding the separated portion of the liner into a space between the plurality of blades and a radially inner surface of the tool body, rotating the base plate about the longitudinal axis, and shredding the separated portion of the liner with the plurality of blades within the space between the plurality of blades and the radially inner surface of the tool body.

In a seventeenth aspect according to any one of the thirteenth aspect to the sixteenth aspect, the blade edge comprises a single edged bevel profile having an angled inner surface, the method further comprising guiding, with the angled inner surface of the blade edge, the separated portion of the liner toward the plurality of blades of the blade system.

In an eighteenth aspect according to any one of the thirteenth aspect to the seventeenth aspect, the method further comprises collecting, with a centralizer connected to the tool body of the well tool, the separated and cut portion of the liner.

In a nineteenth aspect according to the eighteenth aspect, the centralizer comprises a rod oriented along the longitudinal axis and a plurality of barbs connected to the rod and extending radially outward from the rod, wherein collecting the separated and cut portion of the liner comprises catching, with the plurality of barbs of the centralizer, the separated and cut portion of the liner.

In a twentieth aspect, a downhole well tool comprises a tool body oriented along a longitudinal axis, a blade edge connected to the tool body and positioned along a radial perimeter of the tool body, the blade edge positioned at a downhole end of the tool body, and a blade system connected to the tool body and positioned adjacent to and radially inward of the blade edge.

What is claimed is:

1. A well tool for removing a liner, the well tool comprising:

a substantially cylindrical tool body oriented about a longitudinal axis;

a blade edge connected to the tool body and positioned along a radial perimeter of the tool body, the blade edge comprising a single edged bevel profile and positioned at a longitudinal end of the tool body; and a blade system connected to the tool body and comprising a base plate and a plurality of blades connected to the base plate, the plurality of blades oriented about the longitudinal axis on the base plate.

2. The well tool of claim 1, wherein the blade edge is a cylindrical coring blade edge disposed at a longitudinally downhole end of the tool body.

3. The well tool of claim 2, wherein the blade edge extends along an entire perimeter edge of the tool body.

4. The well tool of claim 1, wherein the blade edge is integrally formed with the tool body.

5. The well tool of claim 1, wherein the plurality of blades comprises a plurality of helical blades.

6. The well tool of claim 5, wherein each helical blade in the plurality of blades is oriented in parallel with the longitudinal axis.

7. The well tool of claim 1, wherein the base plate is rotatable about the longitudinal axis and configured to carry the plurality of blades around the longitudinal axis.

8. The well tool of claim 1, wherein the plurality of blades are positioned radially inward of the blade edge and at least partially uphole of the blade edge.

9. The well tool of claim 1, further comprising a centralizer connected to the tool body and positioned longitudinally uphole of or longitudinally downhole of the tool body, the centralizer configured to center the blade edge within a wellbore.

10. The well tool of claim 9, wherein the centralizer is a first centralizer positioned uphole of the tool body, the well tool further comprising a second centralizer positioned downhole of the tool body, the first centralizer and second centralizer configured to center the blade within the wellbore.

11. The well tool of claim 9, wherein the centralizer comprises:

a rod oriented along the longitudinal axis and configured to be oriented longitudinally in the wellbore, and a plurality of barbs connected to the rod and extending radially outward from the rod, the plurality of barbs configured to catch debris residing in the wellbore.

12. A well tool for removing a liner, the well tool comprising:

a substantially cylindrical tool body oriented about a longitudinal axis;

a blade edge connected to the tool body and positioned along a radial perimeter of the tool body, the blade edge positioned at a longitudinal end of the tool body; and a blade system connected to the tool body and comprising a base plate and a plurality of helical blades connected to the base plate, the plurality of helical blades oriented about the longitudinal axis on the base plate.

13. The well tool of claim 12, wherein the blade edge is a cylindrical coring blade edge disposed at a longitudinally downhole end of the tool body.

14. The well tool of claim 13, wherein the blade edge extends along an entire perimeter edge of the tool body.

15. The well tool of claim 12, wherein each helical blade in the plurality of helical blades is oriented in parallel with the longitudinal axis.

16. The well tool of claim 12, wherein the base plate is rotatable about the longitudinal axis and configured to carry the plurality of helical blades around the longitudinal axis.

17. The well tool of claim 12, wherein the plurality of helical blades are positioned radially inward of the blade edge and at least partially uphole of the blade edge.

18. The well tool of claim 12, further comprising a centralizer connected to the tool body and positioned longitudinally uphole of or longitudinally downhole of the tool body, the centralizer configured to center the blade edge within a wellbore.

19. A well tool for removing a liner, the well tool comprising:

a substantially cylindrical tool body oriented about a longitudinal axis;

a blade edge connected to the tool body and positioned along a radial perimeter of the tool body, the blade edge positioned at a longitudinal end of the tool body;

a blade system connected to the tool body and comprising a base plate and a plurality of blades connected to the base plate, the plurality of blades oriented about the longitudinal axis on the base plate; and a centralizer connected to the tool body and positioned longitudinally uphole of or longitudinally downhole of the tool body, the centralizer configured to center the blade edge within a wellbore, the centralizer comprising:

a rod oriented along the longitudinal axis and configured to be oriented longitudinally in the wellbore, and a plurality of barbs connected to the rod and extending radially outward from the rod, the plurality of barbs configured to catch debris residing in the wellbore.

20. The well tool of claim 19, wherein the centralizer is a first centralizer positioned uphole of the tool body, the well tool further comprising a second centralizer positioned downhole of the tool body, the first centralizer and second centralizer configured to center the blade within the wellbore.

* * * * *